US008764139B2

(12) United States Patent
Kanzaki

(10) Patent No.: US 8,764,139 B2
(45) Date of Patent: Jul. 1, 2014

(54) LIQUID EJECTION APPARATUS FOR REDUCING VISIBILITY OF DOTS UNRELATED TO PRINTED IMAGE

(75) Inventor: Takashi Kanzaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 263 days.

(21) Appl. No.: 13/070,208

(22) Filed: Mar. 23, 2011

(65) Prior Publication Data

US 2011/0242153 A1 Oct. 6, 2011

(51) Int. Cl.
*B41J 29/38* (2006.01)

(52) U.S. Cl.
USPC ..... 347/5

(58) Field of Classification Search
None
See application file for complete search history.

(56) References Cited

U.S. PATENT DOCUMENTS

| | | | | |
|---|---|---|---|---|
| 2006/0214961 | A1* | 9/2006 | Nakahara | 347/14 |
| 2007/0200885 | A1* | 8/2007 | Hibi | 347/11 |
| 2009/0167815 | A1* | 7/2009 | Ito | 347/32 |

FOREIGN PATENT DOCUMENTS

| | | | | |
|---|---|---|---|---|
| JP | 2000-117993 | A | | 4/2000 |
| JP | 2002-178534 | A | | 6/2002 |
| JP | 2003080702 | A | * | 3/2003 |
| JP | 2006-297666 | A | | 11/2006 |
| JP | 2008-238644 | A | | 10/2008 |

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

A preliminary vibration number storage unit stores a first preliminary vibration characteristic which indicates a relation between a downtime of an ejection opening and a smallest number of vibrations in preliminary vibration, the smallest number of vibrations required to enable normal preliminary ejection from the ejection opening immediately after the preliminary vibration. The downtime of each ejection opening $T_R$ is irregularly distributed within a range between zero and $T1_{max}$, the range defining the first preliminary vibration characteristic, and preliminary ejection is performed subsequently to the preliminary vibration. At this point, the preliminary vibration performed is set to include $N1_R$ vibrations, the number of which corresponds to the downtime $T_R$ of the first preliminary vibration characteristic.

11 Claims, 10 Drawing Sheets

LIQUID EJECTION APPARATUS FOR REDUCING VISIBILITY OF DOTS UNRELATED TO PRINTED IMAGE

CROSS REFERENCE TO RELATED APPLICATION

The present application Claims priority from Japanese Patent Application No. 2010-083572, which was filed on Mar. 31, 2010, the disclosure of which is herein incorporated by reference in its entirety.

BACKGROUND OF THE INVENTION

1. Field of the Invention

The present invention relates to a liquid ejection apparatus which ejects liquid from ejection openings thereof to record an image on a recording medium, and which performs a preliminary ejection for ejecting liquid nearby the ejection openings to the recording medium for recording thereon the image.

2. Description of Related Art

In general, Inkjet printers having inkjet heads for ejecting ink from a plurality of ejection openings perform, in addition to ejection of ink for image formation, preliminary ejection which eject thickened ink to prevent clog by ink solidified nearby the ejection openings. Such a type of inkjet printers include those which perform the preliminary ejection in parallel to recording of an image and form dots (hereinafter, referred to as flushing dots or preliminary dots) on a recording medium with the ink having been ejected through the preliminary ejection.

SUMMARY OF THE INVENTION

Formation of flushing dots on a recording medium requires reduction of unnecessary preliminary ejection, to restrain deterioration of the image quality by the flushing dots which are not related to the image to be formed. To this end, a possible approach is to perform preliminary ejection for those ejection openings that need the preliminary ejection, instead of performing preliminary ejection uniformly for all the ejection openings of inkjet heads.

More specifically, for example, the following is possible. For each ejection opening, a downtime is obtained which is a consecutive time during which no ink ejection is performed. Then, the preliminary ejection is performed so that the downtime is a maximum downtime which is the longest downtime such that normal ink ejection is possible without ink clog, immediately before the lapse of the downtime. However, for example, in cases of recording ruled lines which perpendicularly cross the conveyance direction of the recording paper, a plurality of ejection openings related to formation of the lines all reach the timing for preliminary ejection at the same time. Accordingly, a plurality of flushing dots are formed along a straight line and the visibility of the flushing dots is therefore increased.

To avoid formation of the flushing dots at a constant position, the downtime of each ejection opening may be varied within the maximum downtime. However, making the downtime shorter than the maximum downtime increases the density of the flushing dots and the visibility of the flushing dots is therefore increased.

In view of the above problems, an object of the present invention is to provide a liquid ejection apparatus which restrains an increase in the visibility of flushing dots.

A liquid ejection apparatus of the present invention includes: a liquid ejection head including a passage unit having a plurality of individual liquid passages respectively extended to ejection openings which eject liquid, and a plurality of actuators each of which applies an ejection energy to the liquid inside the individual liquid passages; an image data storage unit which stores image data related to an image to be recorded on a recording medium; and an image recording control unit which controls the plurality of actuators based on the image data so that the liquid is ejected towards the recording medium which moves relatively to the liquid ejection head, thereby recording the image on the recording medium. The apparatus also includes: a preliminary vibration number storage unit which stores a first preliminary vibration characteristic indicative of a relation between a downtime of one of the ejection openings and a smallest number of vibrations in preliminary vibration, the downtime being a consecutive time during which no liquid ejection is performed from the one of the ejection openings, the smallest number of vibrations being required to enable normal ejection from the one of the ejection openings immediately after the preliminary vibration, the preliminary vibration being performed immediately before the end of the downtime to vibrate a meniscus formed nearby the one of the ejection openings to the extent that the liquid is not ejected from the one of the ejection openings, wherein the first preliminary vibration characteristic includes at least partially a varying range in which the smallest number of vibrations in the preliminary vibration increases with an increase in the downtime, and is defined by a variable range of the downtime which does not exceed a maximum allowable downtime which is a longest downtime such that normal ejection from the one of the ejection openings is possible immediately after the preliminary vibration; and a preliminary operation control unit which controls the plurality of actuators so that respective downtimes of the plurality of ejection openings are not constant within the variable range, and that, for each of the ejection openings, preliminary ejection is performed immediately before the end of the downtime, wherein, in the preliminary ejection, the liquid nearby the each of the ejection openings is ejected by means of non-image-data-based driving of corresponding one of the actuators, towards the recording medium for recording thereon the image, the preliminary ejection being performed subsequently to the preliminary vibration including at least the smallest number of vibrations corresponding to the downtime based on the first preliminary vibration characteristic.

Note that the term "normal ejection" herein means ejection after which the first preliminary vibration characteristic is recovered.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
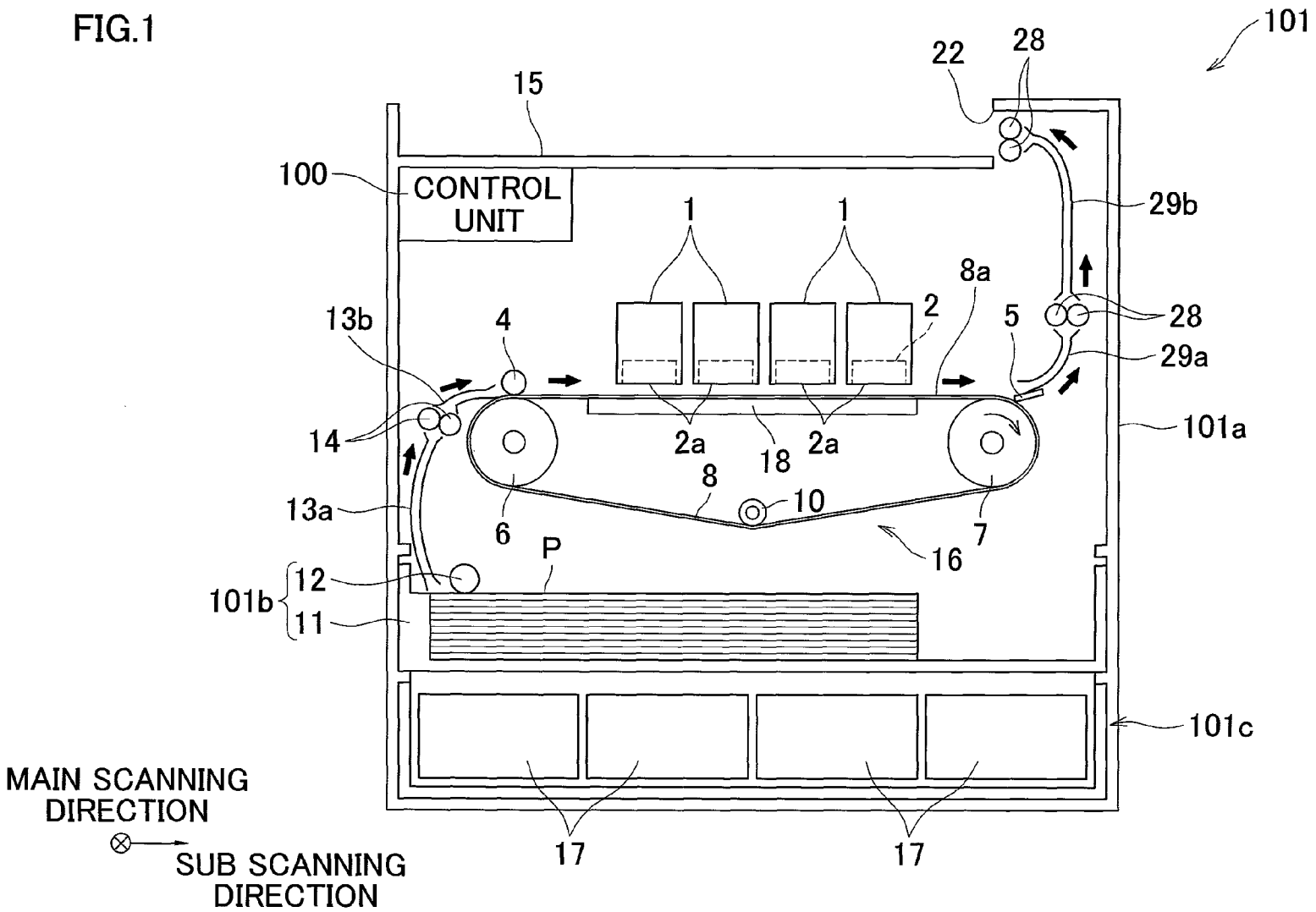
FIG. 1 is a schematic side view showing an overall structure of an inkjet printer of an embodiment, according to the present invention.

An inkjet printer 101 according to a preferable embodiment of the present invention includes a casing 101*a* having a rectangular parallelepiped shape, as shown in FIG. 1. Inside the casing 101*a* are provided: four inkjet heads 1 which eject ink towards a sheet P being conveyed; a conveyance mechanism 16 which conveys the sheet P; a sheet-feeder unit 101*b* which feeds the sheet P; and a tank unit 101*c* for pooling ink. Further, there is disposed a control unit 100 which administrates operations of these mechanisms, in a position where the control unit 100 does not interfere the mechanisms and the like. Further, on top of a top plate of the casing 101*a* is provided an area 15 where ejected sheets P are stacked.

The four inkjet heads 1 have a substantially rectangular parallelepiped shape longer in the main scanning direction, and are aligned and fixed in the conveyance direction (sub scanning direction) of the sheet P. That is, the printer 101 is a line printer, and the conveyance direction and the main scanning direction perpendicularly cross each other.

Figure 3:
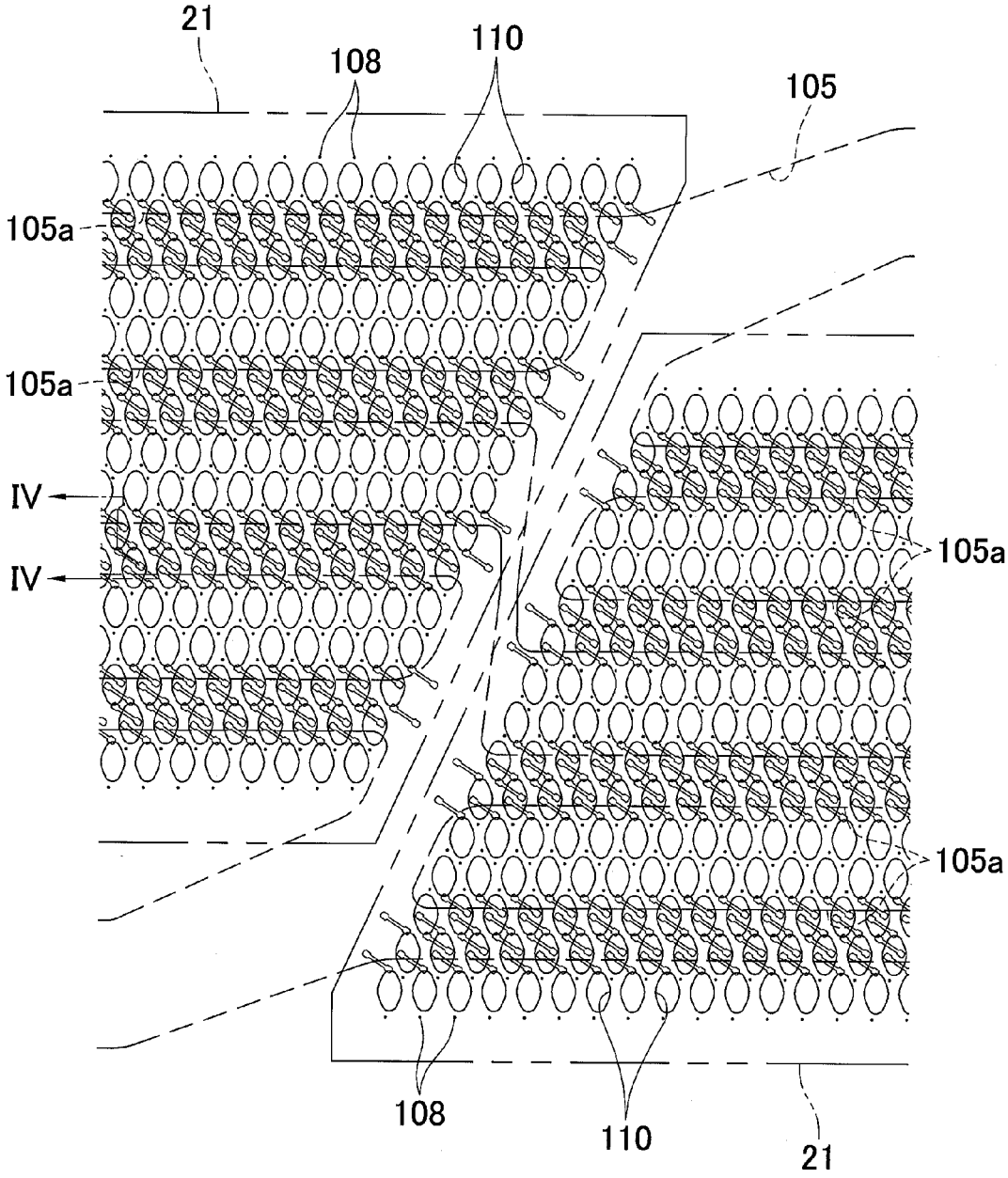
FIG. 3 is an enlarged view of an area surrounded by a dashed line in FIG. 2.
Figure 4:
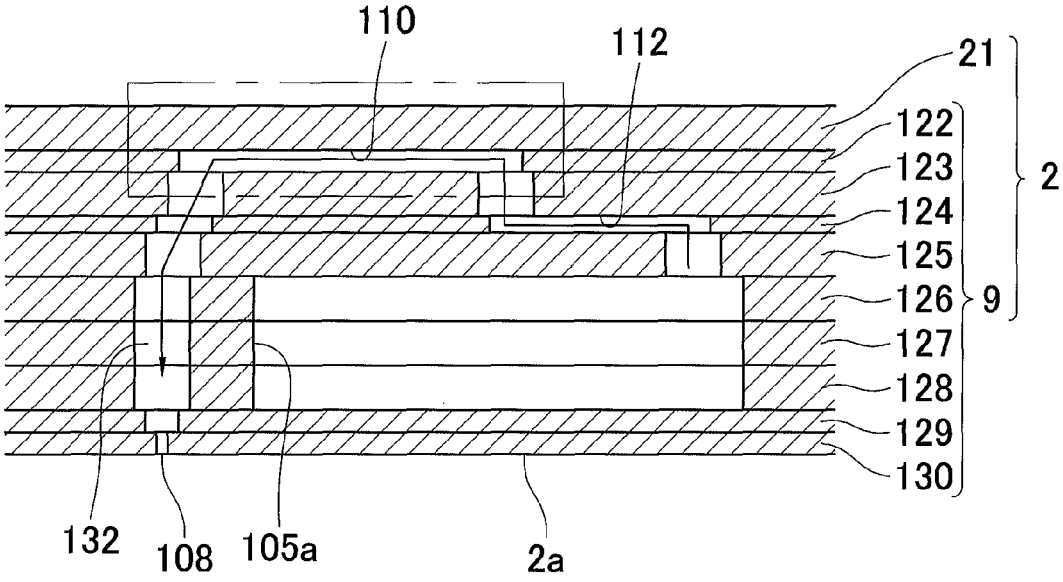
FIG. 4 is a cross sectional view taken along the line IV-IV of FIG. 3.

Each inkjet head 1 has a head main body 2 having a plurality of ejection openings 108 (see FIG. 3 and FIG. 4). The ejection openings 108 are formed on an ejection face 2*a* which is an under surface of the head main body 2. The ejection face 2*a* faces the sheet P being conveyed, and is apart by a predetermined distance. From the ejection openings 108, ink is ejected under control of the control unit 100. Thus, an image is formed on the top surface of the sheet P.

The conveyance mechanism 16 has two belt rollers 6 and 7, a conveyor belt 8, a tension roller 10, and a platen 18. The conveyor belt 8 is an endless belt looped around the rollers 6 and 7, and the tension roller 10 adds a tension to the conveyor belt 8. The platen 18 is disposed at an inside area of the loop formed by the conveyor belt 8, and supports the conveyor belt 8 while creating a space suitable for image formation in a position to face the inkjet heads 1. The belt roller 7 is a drive roller which is driven by a not-shown motor to rotate clockwise in FIG. 1, thus running the conveyor belt 8. The belt roller 6 is a driven roller which rotates when the conveyor belt 8 runs. With the structure, the conveyance mechanism 16 conveys a sheet P placed on the conveyor belt 8 from the left to the right (in the conveyance direction) of FIG. 1.

Note that the conveyor belt 8 of the present embodiment has a not-shown ejection-targeted area. For example, the ejection-targeted area is an opening which let pass the ink ejected from the ejection openings 108, or an area having a recess for receiving the ink ejected. A later mentioned pre-printing ejection of the inkjet heads 1 is performed while the ejection-targeted area faces the ejection faces 2*a* of each inkjet heads 1.

The sheet-feeder unit 101*b* has a sheet-feeder tray 11 and a sheet feeding roller 12. Of these, the sheet-feeder tray 11 is detachably attached to the casing 101*a*. The sheet-feeder tray 11 has a box-shape with its top being opened, and accommodates therein a stack of sheets P. The sheet feeding roller 12, under control by the control unit 100, sends out the uppermost sheet P in the sheet-feeder tray 11. The sheet P having been sent out is fed to the conveyance mechanism 16 by a pair of feed rollers 14 along the guides 13*a* and 13*b*.

The tank unit 101*c* stores therein four ink tanks 17. The ink tanks 17 are detachably attached to the tank unit 101*c*. The ink tanks 17 respectively contain ink of different colors (e.g., Cyan, Magenta, Yellow, and Black). The ink of each ink tank 17 is supplied to the corresponding inkjet head 1 via a not-shown ink tube.

Inside the printer 101 is formed a sheet P conveyance path as is indicated by the black arrows in FIG. 1. The conveyance path overall has an S-shape with its left and right sides being reversed. The sheet P having been sent out from the lower part of the sheet-feeder unit 101*b* is sent to the conveyance mechanism 16 by the pair of feed rollers 14 along the guides 13*a* and 13*b*. When the sheet P passes the front face of the four inkjet heads 1, the ink is successively ejected from the inkjet heads 1 under the control by the control unit 100, thus forming a desirable color image on the top surface of the sheet P. The sheet P on which the image is formed is conveyed by a pair of feed rollers 28 along the guides 29*a* and 29*b*, and is delivered to the area 15 from an exhaust port 22 formed at the top part of the casing 101*a*.

Next, with reference to FIG. 2 to FIG. 5, the following details the head main body 2. Note that FIG. 3 illustrates in solid lines pressure chambers 110, apertures 112, and ejection openings 108 which are below the actuator unit 21, although these parts should be drawn in broken lines.

Figure 2:
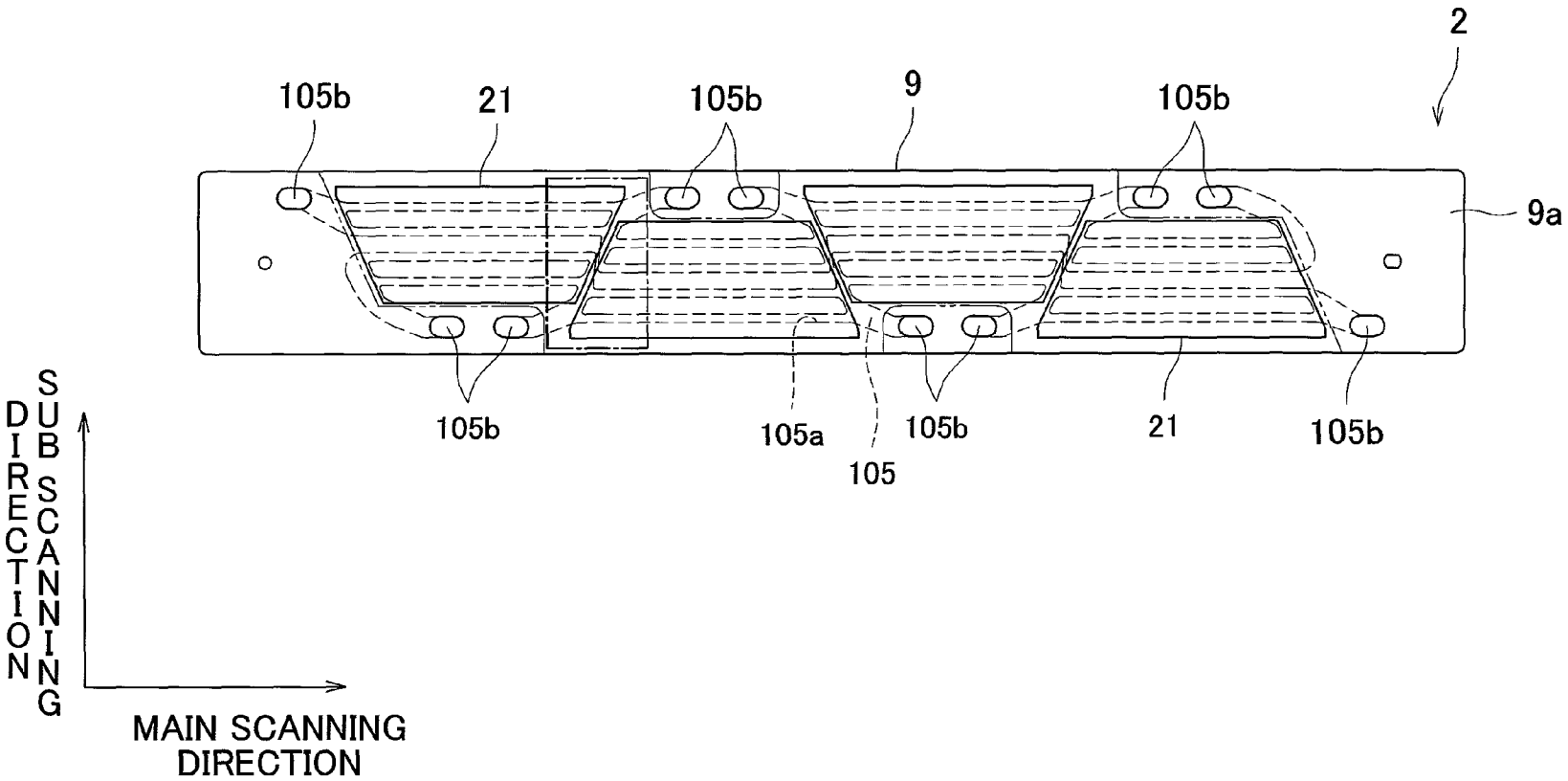
FIG. 2 is a plan view of a head main body shown in FIG. 1.

As shown in FIG. 2, the head main body 2 includes a passage unit 9, and four actuator units 21 fixed to the top surface 9*a* of the passage unit 9. Note that, although illustration is omitted, each inkjet head 1 also includes, in addition to the head main body 2, a reservoir unit which pools ink to be supplied to the passage unit 9, a flexible printed circuit (FPC) which supplies drive signals to the actuator unit 21, a control substrate which controls driver IC mounted on the FPC, and the like.

As shown in FIG. 4, the passage unit 9 is a passage member in which nine plates 122 to 130 are stacked. On the top surface 9*a* of the passage unit 9 are formed in total of ten ink supply openings 105*b* corresponding to the ink outflow passages of the reservoir unit, respectively. Inside the passage unit 9 are formed ink passages extending from the ink supply openings 105*b* on the top surface 9*a* to the ejection openings 108 on the under surface (ejection face 2*a*). Each ink passage includes: a manifold channel 105 whose one end is in communication with the ink supply opening 105*b*, sub manifold channels 105*a* branching off from the manifold channel 105, and a plurality of individual ink passages 132 extending from the respective outlet of the sub manifold channels 105*a* to the ejection openings 108 via pressure chambers 110. On the top surface 9*a*, a number of pressure chambers 110 are opened in addition to the ten ink supply openings 105*b*, which are disposed in matrix as shown in FIG. 3. The ejection face 2*a* has thereon the same number of ejection openings 108 as the pressure chambers 110, which are also aligned in matrix.

The following describes how ink flows in the passage unit 9. Ink supplied from the reservoir unit to the passage unit 9 via the ink supply opening 105*b*, is distributed from each manifold channel 105 to the sub manifold channels 105*a*. The ink inside each sub manifold channel 105*a* flows into individual ink passages 132 and reaches the ejection openings 108 via apertures 112 and the pressure chambers 110.

Next, the following describes the actuator unit 21. As shown in FIG. 2, the four actuator units 21 have a flat trapezoid shape, and are aligned in zigzag in the main scanning direction so as to avoid the ink supply openings 105*b*. Further, the two parallel sides of each actuator unit 21 extend in the main scanning direction, and oblique sides of adjacent actuator units 21 are overlapped with each other relative to the main scanning direction of the passage unit 9.

Figure 5A:
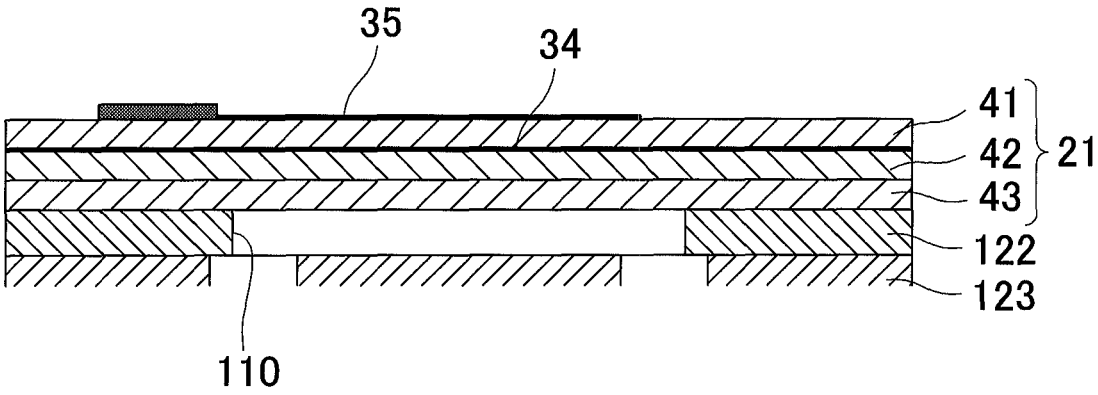
FIG. 5A is an enlarged view of an area surrounded by a dashed line in FIG. 4.
Figure 5B:
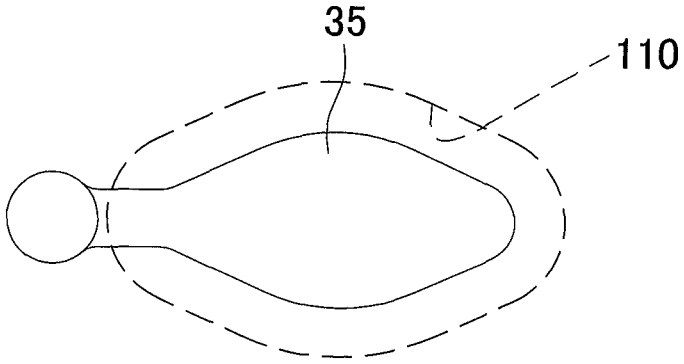
FIG. 5B is a plan view showing an individual electrode.

As shown in FIG. 5(*a*), the actuator unit 21 is structured by three piezoelectric layers 41 to 43 made of a lead zirconate titanate (PZT)-based ceramics material having ferroelectricity. On the surface of the uppermost piezoelectric layer 41 are formed a plurality of individual electrodes 35 each of which is disposed to face the corresponding one of the pressure chambers 110. Between the piezoelectric layer 41 and the lower piezoelectric layer 42 is interposed a common electrode 34 which is formed throughout the entire top surface of the piezoelectric layer 42.

The common electrode 34 is grounded so that a reference potential is equally applied to all the areas corresponding to the pressure chambers 110. On the other hand, the plurality of individual electrodes 35 are individually and electrically connected to the driver IC via internal wiring of the FPC. Therefore, the driver IC is able to selectively supply drive signals to an intended one of or a plurality of individual electrodes 35. That is, in the actuator unit 21, each of a plurality of portions respectively overlapping with the plurality of individual electrodes 35 in plan view functions as an individual actuator. That is, the actuator unit 21 has the same number of actuators as the number of pressure chambers 110.

The following describes an exemplary method of driving the actuator unit 21. The actuator unit 21 is an actuator of so-called unimorph type having the piezoelectric layer 41 as the layer with an active portion, and two piezoelectric layers 42 and 43 as inactive layers. The piezoelectric layer 41 is polarized in the thickness direction. When the electric potential of an individual electrode 35 is changed to a predetermined electric potential and an electric field in the same direction as the polarize direction is applied to the active portion, the active portion shrinks in directions perpendicularly crossing the polarize direction (i.e., in in-plane directions) due to the transversal piezoelectric effect. Since the piezoelectric layers 42 and 43 on the other hand do not spontaneously deform, there will be a difference in the deformation in the in-plane directions between the upper piezoelectric layer 41 and the lower piezoelectric layers 42 and 43. As the result, the entire piezoelectric layers 41 to 43 are deformed to form convex shapes towards the pressure chamber 110 (unimorph deformation).

Such a deformation causes a decrease in the volume of the pressure chamber 110, and applies a pressure (ejection energy) to the ink in the pressure chamber 110. Thus, the ink is ejected from the ejection opening 108. Then, when the potential of the individual electrode 35 is brought back to that of the common electrode 34, the original shapes of the piezoelectric layers 41 to 43 are recovered. The volume of the pressure chamber 110 becomes the original volume, and the ink is sucked into the pressure chamber 110 from the manifold channel 105.

The following driving method is also possible. Namely, the electric potential of an individual electrode 35 is made different from that of the common electrode 34. When there is an eject request, the potential of the individual electrode 35 is temporarily made equal to that of the common electrode 34. After that, the potential of the individual electrode 35 is made different from that of the common electrode 34 again, at a predetermined timing. In this case, the ink is sucked into the pressure chamber 110 from the manifold channel 105 at the timing when the electric potential of the individual electrode 35 is made equal to that of the common electrode 34. When the electric potential of the individual electrode 35 is made different from that of the common electrode 34 again, the ink is ejected.

Figure 6:
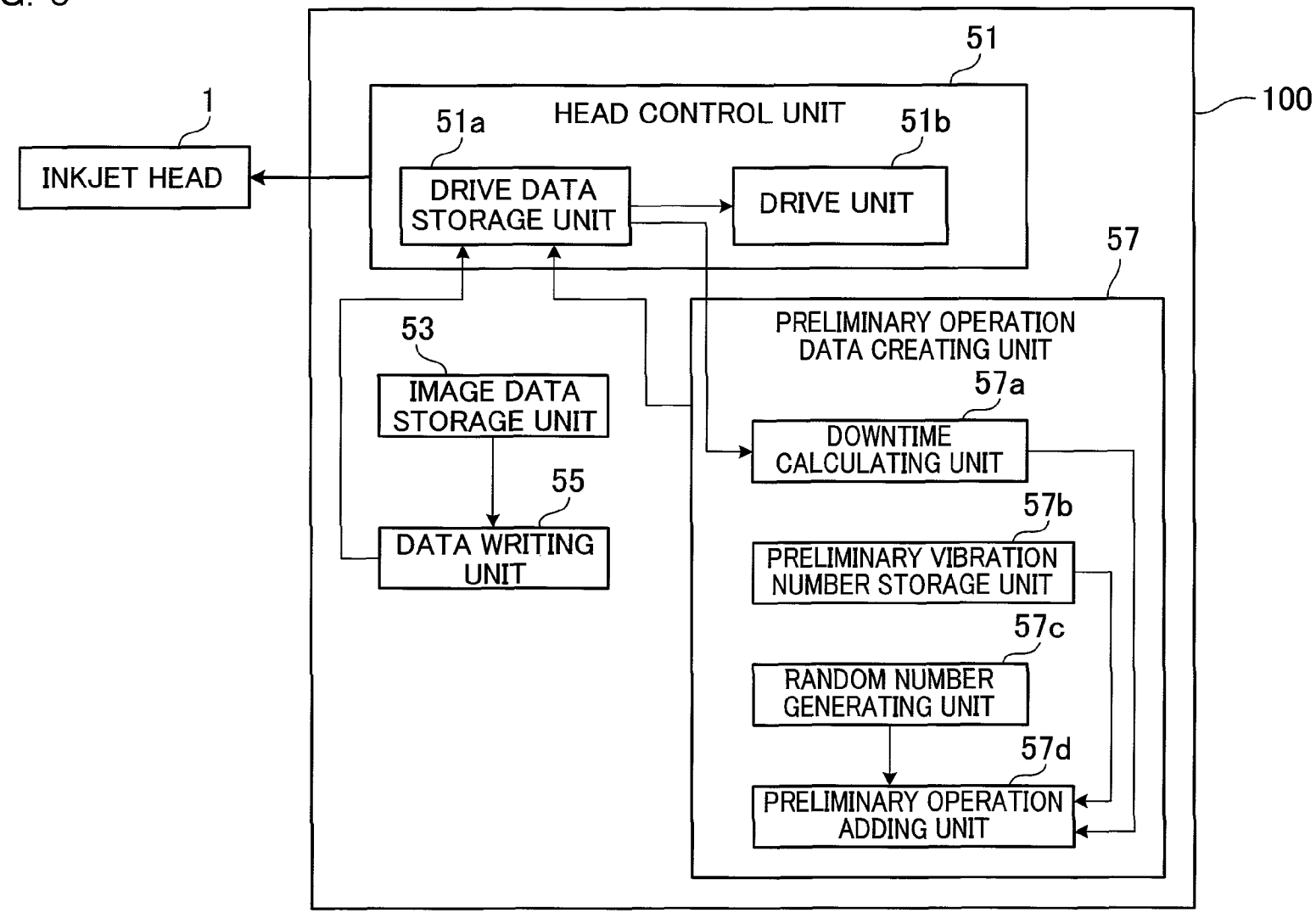
FIG. 6 is a functional block diagram of a control unit shown in FIG. 1.

Next, the following describes the control unit 100 with reference to FIG. 6. The control unit 100 includes: a CPU (Central Processing Unit); a EEPROM (Electrically Erasable and Programmable Read Only Memory) which rewritably stores control programs to be run by the CPU and data to be used in the programs; and a RAM (Random Access Memory) which temporarily stores data while the programs are running. The functional parts structuring the control unit 100 are realized by cooperation of the hardware and software inside the EEPROM. As shown in FIG. 6, the control unit 100 has a head control unit 51, an image data storage unit 53, a data writing unit 55, and a preliminary operation data creating unit 57.

The head control unit 51 controls driving of each actuator in the actuator unit 21 of each inkjet head 1. The head control unit 51 has a drive data storage unit 51*a* which stores drive data of actuators, and a drive unit 51*b* which outputs to each actuator a drive signal for driving the actuator. The drive unit 51*b* includes a driver IC which generates a drive signal which is amplified based on the drive data.

The image data storage unit 53 stores image data transferred from a PC (Personal Computer) or the like connected to the inkjet printer 101. In addition to the number of printings in a print job, the image data indicates, for each ejection opening 108, an ink ejection amount (zero, a small droplet, a medium droplet, or a large droplet) of each color and dot formation position or the like of a plurality of printing cycles. Note that each printing cycle is a time required for the inkjet head 1 and a sheet P to move relatively to each other in the sheet conveyance direction, by a unit distance corresponding to the printing resolution.

The data writing unit 55 writes image data stored in the image data storage unit 53 into the drive data storage unit 51*a* of the head control unit 51. This way, driving of each actuator in the actuator unit 21 is controlled based on the image data stored in the image data storage unit 53. That is, the head control unit 51 and the data writing unit 55 function as an image recording control unit.

The preliminary operation data creating unit generates preliminary operation data and outputs the same to the drive data storage unit 51*a* of the head control unit 51. Based on this preliminary operation data, each actuator of the actuator unit 21 is controlled. In other words, the head control unit 51 and the preliminary operation data creating unit 57 function as a preliminary operation control unit. The preliminary operation data of the present embodiment is data for performing preliminary vibration and/or preliminary ejection. The preliminary vibration is for vibrating a meniscus formed nearby each ejection opening 108 to the extent that the ink is not ejected from the ejection opening 108. The preliminary ejection is for ejecting the ink from the ejection opening 108 to a sheet P, after the preliminary vibration. This preliminary ejection is not based on data related to an image to be recorded. The preliminary operation data creating unit 57 includes a downtime calculating unit 57*a*, a preliminary vibration number storage unit 57*b*, a random number generating unit 57*c* and a preliminary operation adding unit 57*d*.

The downtime calculating unit 57*a* calculates downtimes based on the image data stored in the image data storage unit 53. Each downtime is a consecutive time during with ink ejection is performed from an ejection opening 108. The length of the downtime is a multiple of the printing cycle. Note that the present embodiment deals with a case where the pre-printing ejection is performed immediately before printing to the sheet P starts; i.e., immediately before the leading end of the sheet P reaches an area to face the inkjet head 1. In the pre-printing ejection, all the ejection openings 108 eject ink towards the ejection area of the conveyor belt 8. Thus, the downtime ranging from the pre-printing ejection to the ejection of ink to the sheet P is calculated from the point of starting printing to the sheet P based on the image data.

The preliminary vibration number storage unit 57*b* stores preliminary vibration characteristics indicative of a relation between the downtime and a smallest number of vibrations in the preliminary vibration performed immediately before the end of the downtime, the smallest number of vibrations being required to enable normal ink ejection from an ejection opening 108 immediately after the preliminary vibration. The ink inside the ejection opening 108 is agitated through the preliminary vibration performed immediately before the ink ejection. This restrains the ink inside the ejection opening 108 from being thickened therein. In the present embodiment, the preliminary vibration number storage unit 57*b* stores two preliminary vibration characteristics which are: a first preliminary vibration characteristic indicated by a curve 91 of FIG. 7, and a second preliminary vibration characteristic indicated by a curve 92 of FIG. 7.

The number of vibrations of the first preliminary vibration characteristic is a smallest number of vibrations in the preliminary vibration, which number is required to enable normal preliminary ejection from an ejection opening 108 immediately after the ejection opening 108 is subjected to the preliminary vibration. Specifically, the smallest number of vibrations in the preliminary vibration of the first preliminary vibration characteristic is a minimum number of vibrations required for an ejection opening 108 to eject an amount of ink instructed by a drive signal related to the preliminary ejection, upon reception of the drive signal by the corresponding actuator, thereby forming on a sheet P flushing dots with the size and shape or the like instructed by the drive signal.

Figure 7:
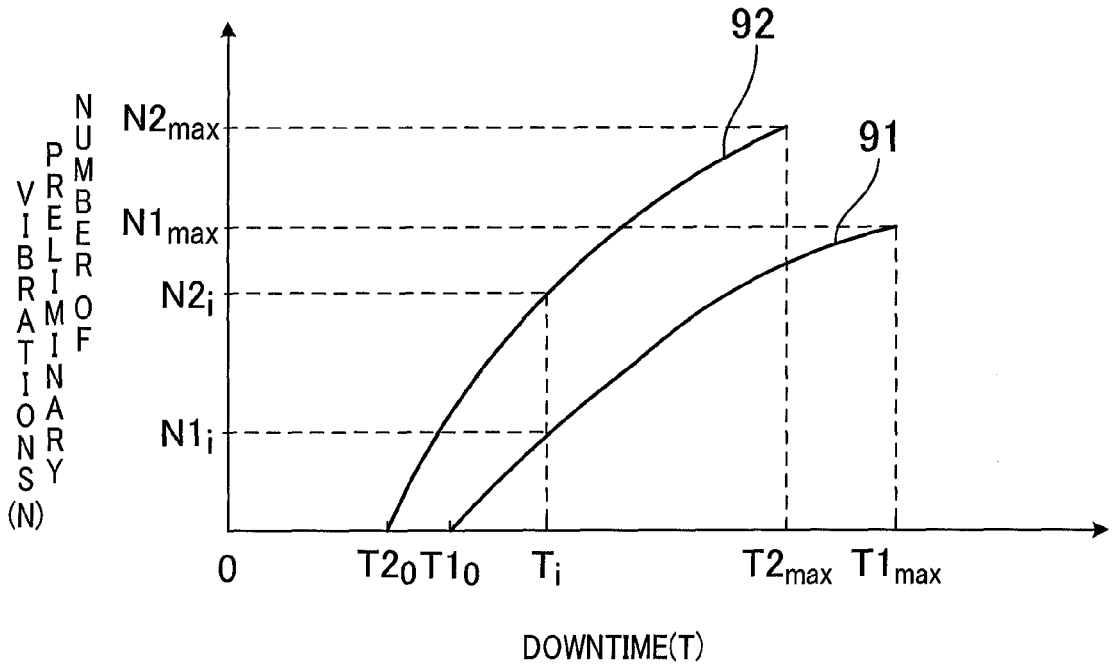
FIG. 7 is a graph showing the respective curves of first and second preliminary vibration characteristics stored in a preliminary vibration number storage unit shown in FIG. 6.

As shown in FIG. 7, the first preliminary vibration characteristic is defined by a variable range from the time point zero to the time point $T1_{max}$. Between the time point zero to the time point $T1_0$, the smallest number of vibrations is zero irrespective of the length of the downtime. A range between the time point $T1_0$ and the time point $T1_{max}$ is a varying range in which the smallest number of vibrations increases with an increase in the downtime. The smallest number of vibrations at the time point $T1_{max}$ is $N1_{max}$. Note that the time point $T1_{max}$ is a maximum downtime (maximum allowable downtime) such that normal preliminary ejection is possible immediately after the preliminary vibration. In other words, normal preliminary ejection is not possible once the downtime exceeds the maximum allowable downtime, even with the number of vibrations in the preliminary vibration being $N1_{max}$ or more.

The number of vibrations of the second preliminary vibration characteristic is a smallest number of vibrations in the preliminary vibration, which number is required to enable normal ink ejection from an ejection opening 108 based on image data stored in the image data storage unit 53, immediately after the ejection opening 108 is subjected to the preliminary vibration. Specifically, the smallest number of vibrations in the preliminary vibration of the second preliminary vibration characteristic is a minimum number of vibrations required for an ejection opening 108 to eject an amount of ink instructed by a drive signal which causes ink ejection based on image data, upon reception of that drive signal by the corresponding actuator, thereby forming on a sheet P image dots with the size and shape or the like instructed by the drive signal.

As shown in FIG. 7, the second preliminary vibration characteristic is defined by a range from the time point zero to the time point $T2_{max}$. The smallest number of vibrations is zero between the time point zero to the time point $T2_0$, irrespective of the length of the downtime. Between the time point $T2_0$ and the time point $T2_{max}$, the smallest number of vibrations increases with an increase in the downtime. The smallest number of vibrations at the time point $T2_{max}$ is $N2_{max}$. Note that the time point $T2_0$ occurs earlier than the time point $T1_0$, and the time point $T2_{max}$ occurs earlier than the time point $T1_{max}$, in relation to the downtime.

Ink ejection based on image data requires higher accuracy of ink placement than that required in the preliminary ejection. When comparing the numbers of vibrations relative to the time point $T_i$, the number of vibrations $N2_i$ of the second preliminary vibration characteristic is more than the number of vibrations $N1_i$ of the first preliminary vibration characteristic. In other words, when ink ejection is to be performed based on image data, the number of vibrations in the preliminary vibration is made greater than that in the preliminary vibration performed before the preliminary ejection, for the purpose of reliably restraining the ink inside the ejection opening 108 from thickening. This way highly accurate placement of ejected ink is possible, when the ink is ejected based on image data.

The random number generating unit 57*c* generates a random number within an instructed range. The preliminary operation adding unit 57*d* adds data related to the preliminary vibration and data related to the preliminary ejection to the drive data stored in the drive data storage unit 51*a*, to irregularly distribute the downtime of each ejection opening 108 within the variable range defining the first preliminary vibration characteristic; i.e., from the time point zero to the time point $T1_{max}$. Note that the data related to preliminary ejection does not necessarily have to be added to the drive data. Specifically, the preliminary vibration and the preliminary ejection are added when a drive signal having a waveform as shown in FIG. 8(*a*) or FIG. 8(*c*) is applied to the actuator based on drive data generated from image data; i.e., the downtime calculated by the downtime calculating unit 57*a* exceeds the time point T2.

Figure 8:
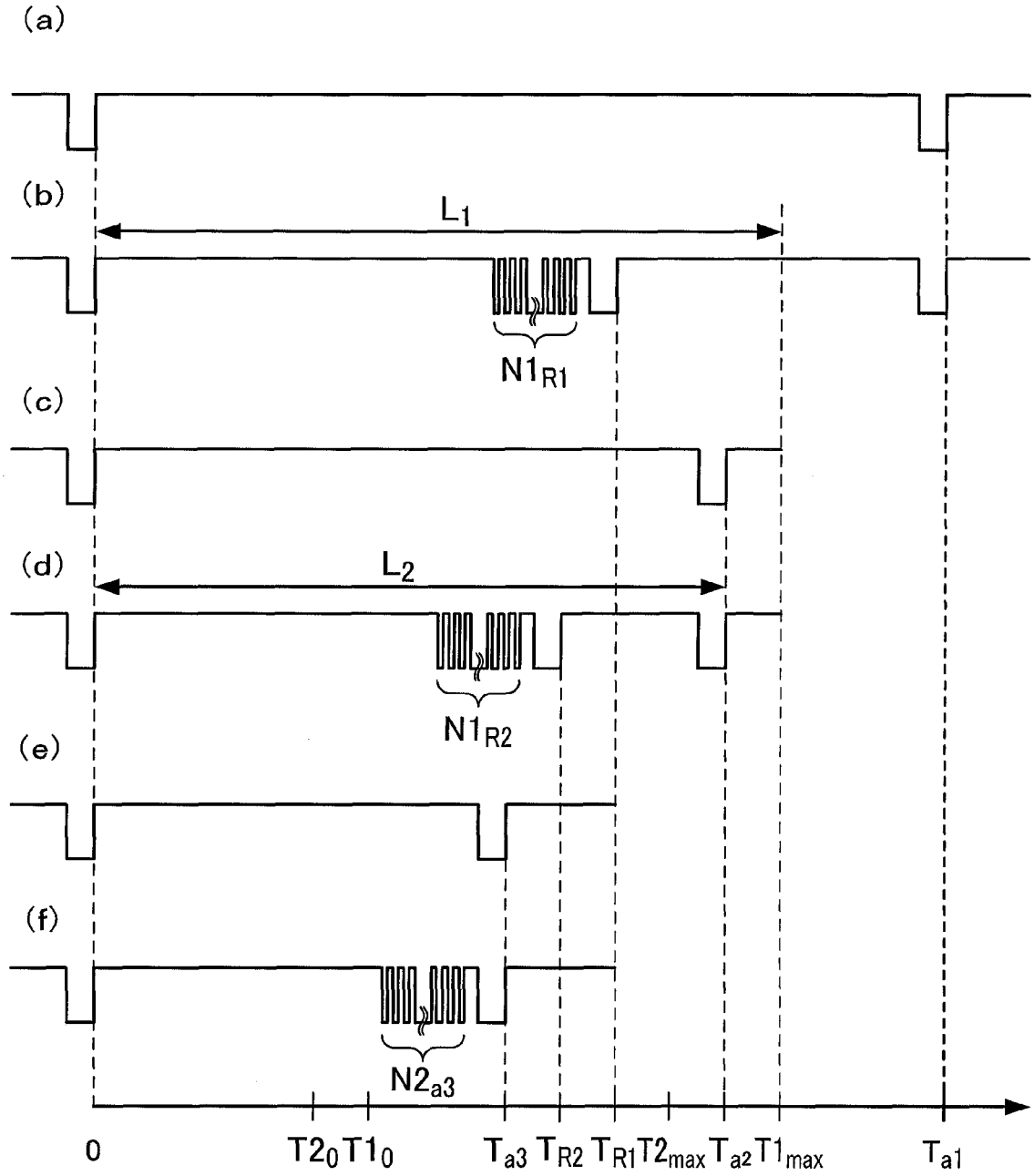
FIG. 8 is a diagram explaining addition of preliminary ejection and preliminary vibration by a preliminary operation adding unit and preliminary ejection adding unit shown in FIG. 6.

More specifically, when the downtime $T_{a1}$ exceeds the time point $T1_{max}$ as shown in FIG. 8(*a*), the preliminary operation adding unit 57*d* causes the random number generating unit 57*c* to generate a random number $T_{R1}$ in a range $L_1$ covering the time point zero to the time point $T1_{max}$. As shown in FIG. 8(*b*), the preliminary operation adding unit 57*d* adds data of the preliminary vibration and data of the preliminary ejection to the drive data to cause the ejection opening 108 to perform the preliminary vibration and the preliminary ejection in this order, immediately before the downtime of the ejection opening 108 reaches the time point $T_{R1}$. The preliminary vibration in this case is set to include $N1_{R1}$ vibrations, the number of which corresponds to the time point $T_{R1}$ of the first preliminary vibration characteristic.

Further, as shown in FIG. 8(*c*), when the downtime $T_{a2}$ exceeds the time point $T2_{max}$ but not the time point $T1_{max}$, the preliminary operation adding unit 57*d* causes the random number generating unit 57*c* to generate a random number $T_{R2}$ in a range $L_2$ covering the time point zero to the time point $T_{a2}$. The preliminary operation adding unit 57*d* also adds data of the preliminary ejection and data of the preliminary vibration to the drive data to cause the ejection opening 108 to perform the preliminary vibration and the preliminary ejection in this order, immediately before the downtime of the ejection opening 108 reaches the time point $T_{R2}$. The preliminary vibration in this case is set to include $N1_{R2}$ vibrations, the number of which corresponds to the time point $T_{R2}$ of the first preliminary vibration characteristic.

The preliminary operation adding unit 57*d* adds data related to the preliminary vibration to the drive data stored in the drive data storage unit 51*a*, based on the downtime calculated by the downtime calculating unit 57*a*. Specifically, the preliminary vibration is added when a drive signal applied to the actuator based on the drive data generated from the image data has a waveform as shown in FIG. 8(*e*); i.e., when the downtime $T_{a3}$ calculated by the downtime calculating unit 57*a* exceeds the time point $T2_0$ but not the time point $T2_{max}$. More specifically, the preliminary vibration to be performed immediately before the downtime reaches the time point $T_{a3}$ is set to include $N2_{a3}$ vibrations, the number of which corresponds to the time point $T_{a3}$ of the second preliminary vibration characteristic.

Figure 9:
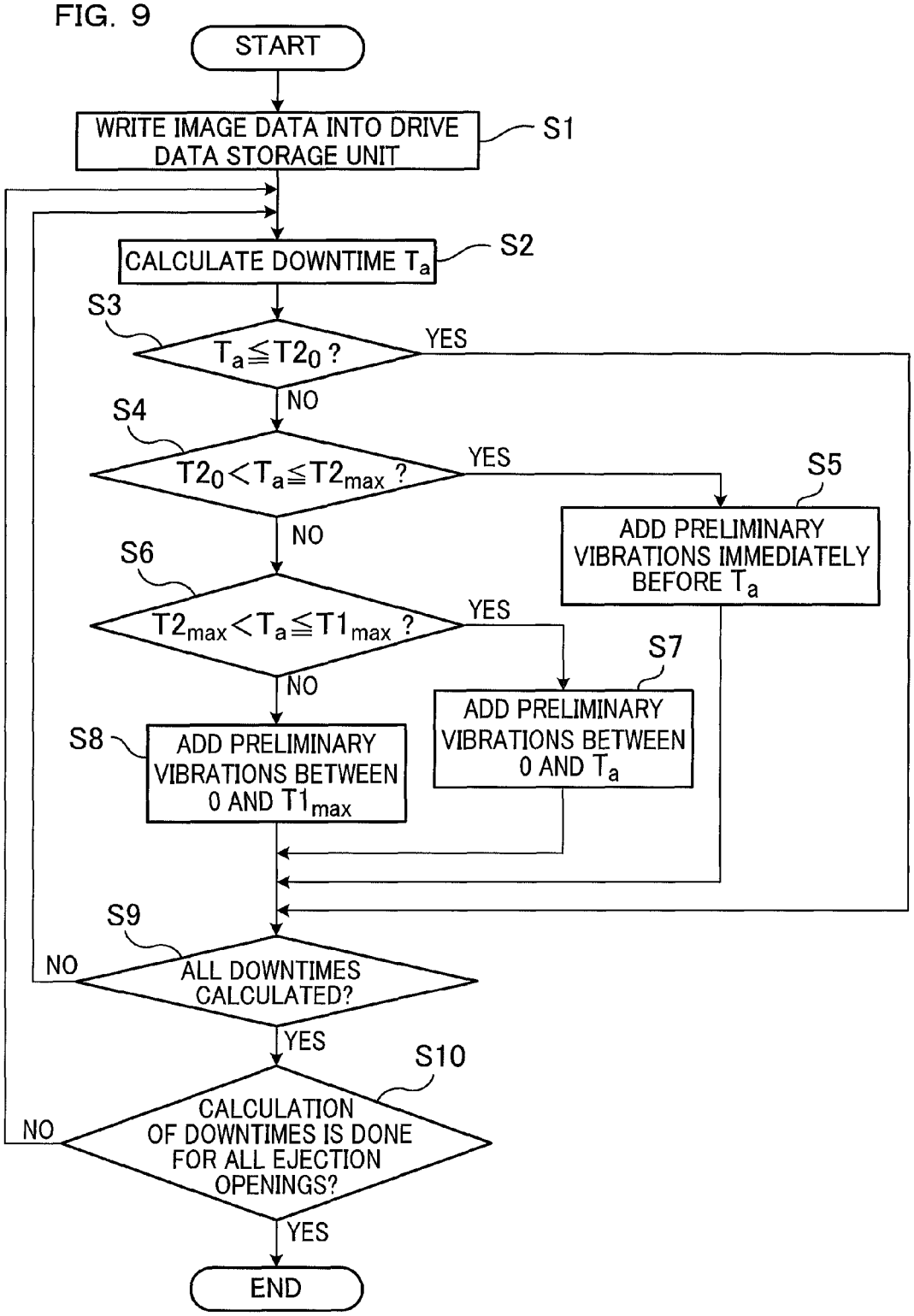
FIG. 9 is a flowchart showing an exemplary sequence of processes performed by the control unit shown in FIG. 1.

Next, with reference to FIG. 9, the following describes an exemplary procedure of processes performed by the control unit 100. Note that the processes of the FIG. 9 are started after image data from the outside is stored in the image data storage unit 53.

First, image data stored in the image data storage unit 53 by the data writing unit 55 is written into the drive data storage unit 51*a* (step S1). Next, the downtime calculating unit 57*a* of the preliminary operation data creating unit 57 calculates the downtime $T_a$ based on drive data stored in the drive data storage unit 51*a* (step S2). More specifically, the downtime of a single ejection opening 108 is calculated. Then, there is determined whether the downtime $T_a$ calculated in step S2 is not longer than $T2_0$(step S3). If the downtime $T_a$ is not longer than $T2_0$ (step S3: YES), the process goes to a later-mentioned step S9.

On the other hand, if the downtime $T_a$ exceeds the $T2_0$ (step S3: NO), there is determined whether the downtime $T_a$ is not longer than $T2_{max}$(step S4). When the downtime $T_a$ is not longer than $T2_{max}$ (step S4: YES), data related to the preliminary vibration is added to the drive data in the drive data storage unit 51*a* so that the preliminary vibration to be performed immediately before the downtime reaches $T_a$ includes $N2_a$ vibrations, the number of which corresponds to the time point $T_a$ of the second preliminary vibration characteristic (step S5). The process then goes to the later-mentioned step S9.

When the downtime $T_a$ exceeds the $T2_{max}$ (step S4: NO), there is determined whether the downtime $T_a$ is not longer than $T1_{max}$ (step S6). If the downtime $T_a$ is shorter than $T1_{max}$ (step S6: YES), the random number generating unit 57*c* generates a random number $T_R$ within a range from zero to $T_a$, and data related to the preliminary vibration and data related to the preliminary ejection are added to drive data stored in the drive data storage unit 51*a* so that the preliminary vibration and the preliminary ejection are performed in this order immediately before the downtime reaches $T_R$(step S7). At this time, the downtime $T_a$ needs to be re-calculated in relation to the time after the downtime $T_R$. Note that the preliminary vibration at this time is set to include $N1_R$ vibrations, the number of which corresponds to the downtime $T_R$ of the first preliminary vibration characteristic. After that, the process goes to the later-mentioned step S9.

On the other hand, if the downtime $T_a$ exceeds $T1_{max}$ (step S6: NO), the random number generating unit 57*c* generates a random number $T_R$ within a range of zero to $T1_{max}$, and data related to the preliminary vibration and data related to the preliminary ejection are added to the drive data stored in the drive data storage unit 51*a* so that the preliminary vibration and the preliminary ejection are performed in this order, immediately before the downtime reaches $T_R$(step S8). At this time too, the downtime $T_a$ needs to be re-calculated in relation to the time after the downtime $T_R$. Note that the preliminary vibration at this time is set to include $N1_R$ vibrations, the number of which corresponds to the downtime $T_R$ of the first preliminary vibration characteristic. After that, the process goes to the later-mentioned step S9.

After the steps S5, S7, and S8, there is determined if all the downtimes are calculated in relation to the ejection opening 108 for which calculation of the downtime has been performed in step S2 (step S9). When the calculation of all the downtimes are not yet completed (step S9: NO), the process returns to step S2 and another downtime is calculated. Note that, when the preliminary ejection is added in steps S7 and S8, the downtime is calculated for the time after the preliminary ejection added.

On the other hand, when all the downtimes are calculated in relation to the ejection opening 108 (step S9: YES), there is determined whether calculation of the downtimes is completed for all the ejection openings 108 (step S10). If there is an ejection opening 108 whose downtime is yet to be calculated (step S10: NO), the process returns to the step S2. On the other hand, if calculation of the downtime is completed for all the ejection openings 108 (step S10: YES), the process is ended.

Figure 10:
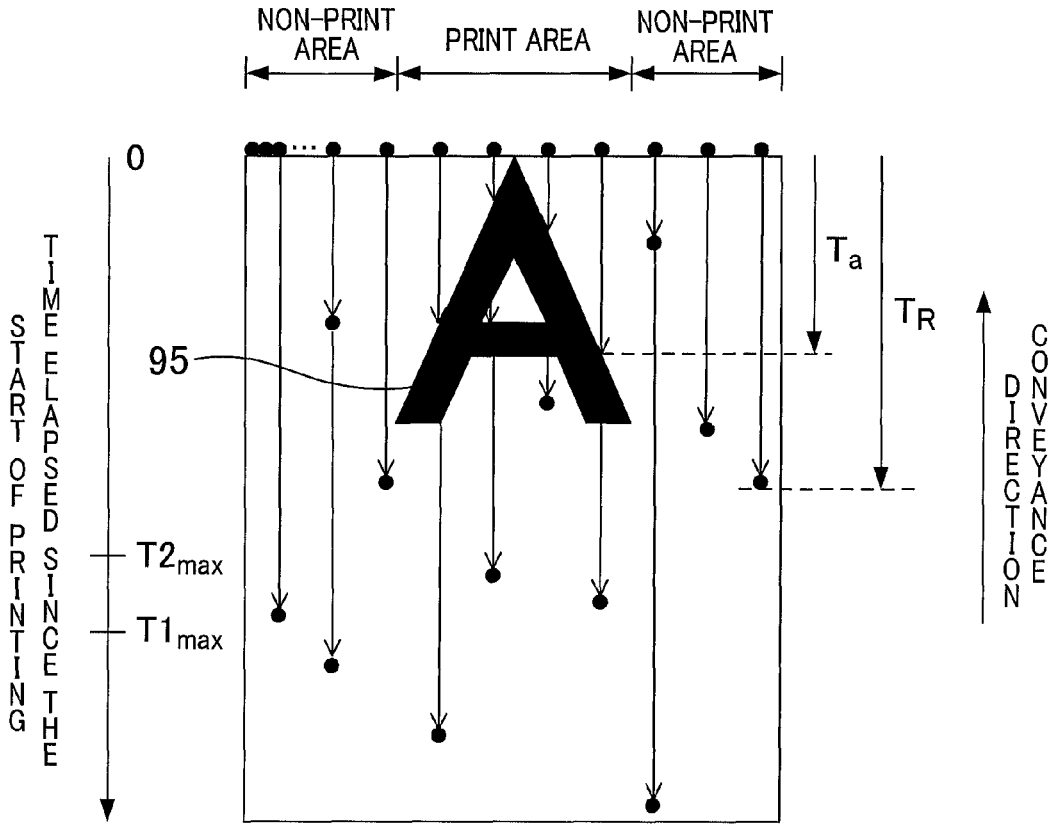
FIG. 10 is a diagram showing an exemplary printed material created by the inkjet printer shown in FIG. 1.

The following describes with reference to FIG. 10 an exemplary printed material created by the above mentioned inkjet printer 101. FIG. 10 shows a sheet P on which an image 95 is formed. The image 95 is formed in the substantially middle portion of the sheet P relative to the main scanning direction perpendicularly crossing the conveyance direction. Thus, the middle portion of the sheet P relative to the main scanning direction is a print area, and each area beside the print area is a non-print area.

For each ejection opening 108 facing the non-print area, the downtime from the start of printing to the sheet P, which is after the pre-printing ejection, exceeds $T1_{max}$. The random number generating unit 57*c* therefore generates a random number $T_R$ within a range from zero to $T1_{max}$, and the preliminary operation adding unit 57*d* adds the preliminary vibration and the preliminary ejection to have the preliminary vibration and the preliminary ejection performed in this order immediately before the downtime reaches $T_R$. Note that the preliminary vibration at this time includes $N1_R$ vibrations, the number of which corresponds to the downtime $T_R$ of the first preliminary vibration characteristic. This way, flushing dots are randomly formed between the leading end of the sheet P (the upper end in FIG. 10) and a portion of the sheet P to face the inkjet head 1, upon elapse of the time $T1_{max}$ from the start of the printing. When the downtime after the preliminary ejection exceeds $T2_{max}$, another preliminary ejection is added.

Meanwhile, in the print area, the image 95 is formed between the leading end of the sheet P and the portion of the sheet P to face the inkjet head 1 after elapse of time $T2_{max}$ from the start of printing. For each ejection opening 108 facing the print area, the downtime $T_a$ between the start of printing to the sheet P after the pre-printing ejection and ink ejection for forming image dots structuring the image 95 is $T2_{max}$ or less. Such an ejection opening 108 therefore does not perform preliminary ejection. After the start of printing, the preliminary vibration including $N2_a$ vibrations, number of which corresponds to the time point $T_a$ of the second preliminary vibration characteristic, is performed immediately before the ink ejection for formation of image dots.

When the downtime after formation of image dots structuring the leading edge of the image 95 is $T2_0$ or longer but not longer than $T2_{max}$, the preliminary vibration is performed immediately before the ink ejection for forming the next image dots. At this time too, the preliminary vibration includes $N2_a$ vibrations, the number of which corresponds to the time point $T_a$ of the second preliminary vibration characteristic. On the other hand, if the downtime exceeds the $T2_{max}$, calculation of the downtime $T_a$, determination of the downtime $T_R$, addition of the preliminary vibration, and additional of the preliminary ejection are repeated. Thus, flushing dots are formed on the downstream side of the image 95 relative to the conveyance direction.

As hereinabove described, in the inkjet printer 101 of the present embodiment, the preliminary vibration number storage unit 57*b* stores therein the first preliminary vibration characteristic which indicates a relation between the downtime of an ejection opening 108 and the smallest number of vibrations in the preliminary vibration, the smallest number being required to enable normal preliminary ejection from the ejection opening 108 immediately after the ejection opening 108 is subjected to the preliminary vibration. Further, the data writing unit 55 writes image data stored in the image data storage unit 53 into the drive data storage unit 51*a* of the head control unit 51. The preliminary operation adding unit 57*d* of the preliminary operation data creating unit 57 adds data of the preliminary ejection and data of the preliminary vibration to the drive data stored in the drive data storage unit 51*a* so that the respective downtimes $T_R$ of the ejection openings 108 are not constant within the variable range from zero to $T1_{max}$, the range defining the first preliminary vibration characteristic. The preliminary vibration immediately before the end of the downtime enables a longer downtime than cases without the preliminary vibration. Thus, even if the respective downtimes of the ejection openings 108 are made shorter than the maximum allowable downtime to avoid a constant downtime, it is possible to restrain an increase in the density of the flushing dots formed on a sheet P by the preliminary ejections each performed immediately before the end of a downtime. As a result, an increase in the visibility of the flushing dots is restrained.

Further, in the inkjet printer 101 of the present embodiment, the preliminary operation adding unit 57*d* causes the random number generating unit 57*c* to generate a random number $T_R$ and adds the preliminary ejection and preliminary vibration to have an ejection opening 108 perform the preliminary vibration and the preliminary ejection in this order, immediately before the downtime of the ejection opening 108 reaches the $T_R$. The respective downtimes of the plurality of ejection openings 108 are made irregular, which enables restraint of an increase in the visibility of the flushing dots.

Further, in the inkjet printer 101 of the present embodiment, the preliminary vibration is set to include $N1_R$ vibrations, the number of which corresponds to the downtime $T_R$ of the first preliminary vibration characteristic. The preliminary vibration performed includes a smallest number of vibrations required for enabling normal preliminary ejection, according to the length of the downtime $T_R$. Therefore, unnecessary driving of the actuator is restrained. Thus, reduction of the life of the actuator is prevented. Further, the power consumption associated with the preliminary vibration is restrained.

Further, in the inkjet printer 101 of the present embodiment, the first preliminary vibration characteristic is defined by the variable range covering the downtime zero at which the smallest number of vibrations in the preliminary vibration is zero and $T1_{max}$ which is the maximum allowable downtime. Since the range in which the downtime is set covers the point where the smallest number of vibrations in the preliminary vibration is zero, the degree of freedom for setting the downtime is improved. Further, the power consumption associated with the preliminary vibration is restrained. Further, the range in which the downtime is set also covers the maximum allowable downtime; i.e., the longest downtime such that normal ejection is possible. Therefore, the density of the flushing dots is effectively lowered, an increase in the visibility of the flushing dots is reliably restrained.

Further, in the inkjet printer 101 of the present embodiment, the preliminary vibration number storage unit 57*b* stores therein the second preliminary vibration characteristic which indicates a relation between the downtime of an ejection opening 108 and the smallest number of vibrations in the preliminary vibration, the smallest number being required to enable normal ink ejection from the ejection opening 108 based on image data, immediately after the ejection opening 108 is subjected to the preliminary vibration. When the downtime $T_a$ is not longer than $T2_{max}$ which is the maximum downtime defined by the second preliminary vibration characteristic, the preliminary operation adding unit 57*d* does not add the preliminary ejection. The number of the preliminary ejections therefore is reduced.

Further, in the inkjet printer 101 of the present embodiment, when the downtime $T_a$ is equal to or longer than $T2_0$ but not longer than $T2_{max}$, the preliminary operation adding unit 57*d* adds the preliminary vibration to have the preliminary vibration including $N2_a$ vibrations, the number of which corresponds to the downtime $T_a$ of the second preliminary vibration characteristic, is performed immediately before the downtime reaches $T_a$. Thus, number of vibrations in the preliminary vibration to be performed immediately before the end of a downtime (i.e., before the start of ink ejection) is determined based on different vibration characteristics which are respectively suitable for a case of performing preliminary ejection and a case of performing ink ejection based on image data. In short, the number of vibrations in the preliminary vibration is determined according to the ejection accuracy required.

The above embodiment deals with a case where the preliminary operation adding unit 57*d* causes the random number generating unit 57*c* to generate the random number $T_R$ and adds preliminary ejection so that the downtime is ended at $T_R$, and where the respective downtimes of the ejection openings are irregularly distributed. The present invention however is not limited to this. For example, the downtimes may be regularly distributed, provided that the respective downtimes of the plurality of ejection openings are not constant. Further, the downtimes may be regularly or irregularly distributed by determining $T_R$ of each downtime based on a series of numbers in an regular or irregular order, instead of the random number generated.

Further, the above embodiment deals with a case where the preliminary vibration is set to include: $N1_R$ vibrations, the number of which corresponds to the downtime $T_R$ of the first preliminary vibration characteristic; or $N2_R$ vibrations, the number of which corresponds to the downtime $T_R$ of the second preliminary vibration characteristic. However, the number of vibrations in the preliminary vibration is not limited, provided that the number is at least $N1_R$ or $N2_R$.

Further, the above embodiment deals with a case where the first preliminary vibration characteristic is defined by the variable range covering the downtime zero at which the smallest number of vibrations in the preliminary vibration is zero, and $T1_{max}$ which is the maximum allowable downtime. The first preliminary vibration characteristic however is not limited to this. The first preliminary vibration characteristic may be any given characteristic, provided that the first preliminary characteristic includes at least partially a varying range in which the smallest number of vibrations in the preliminary vibration increases with an increase in the downtime, and that the first preliminary characteristic is defined by a range which does not exceeds a maximum allowable downtime.

Further, the above embodiment deals with a case where, when the downtime $T_a$ is equal to or longer than $T2_0$ but not longer than $T2_{max}$ which is a maximum downtime defined by the second preliminary vibration characteristic, the preliminary operation adding unit 57*d* adds the preliminary vibration to be performed immediately before the downtime reaches $T_a$, the preliminary vibration including $N2_a$ vibrations, the number of which corresponds to the downtime $T_a$ of the second preliminary vibration characteristic. However, the present invention is not limited to this. That is, the second preliminary vibration characteristic may be omitted. For example, when the downtime $T_a$ is not longer than $T1_{max}$ which is the maximum downtime defined by the first preliminary vibration characteristic, the preliminary operation adding unit 57*d* may add the preliminary vibration to be performed immediately before the downtime reaches $T_a$, which vibration includes $N1_a$ vibrations, the number of which corresponds to the downtime $T_a$ of the first preliminary vibration characteristic. In this case, the preliminary vibration is not performed as long as the downtime $T_a$ is shorter than $T1_0$.

While this invention has been described in conjunction with the specific embodiments outlined above, many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus, comprising:

a liquid ejection head including a passage unit having a plurality of individual liquid passages respectively extended to ejection openings which eject liquid, and a plurality of actuators each of which applies an ejection energy to the liquid inside the individual liquid passages;

an image data storage unit which stores image data related to an image to be recorded on a recording medium;

an image recording control unit which controls the plurality of actuators based on the image data so that the liquid is ejected towards the recording medium which moves relatively to the liquid ejection head, thereby recording the image on the recording medium;

a preliminary vibration number storage unit which stores a first preliminary vibration characteristic indicative of a relation between a downtime of one of the ejection openings and a smallest number of vibrations in preliminary vibration, the downtime being a consecutive time during which no liquid ejection is performed from the one of the ejection openings, the smallest number of vibrations being required to enable normal ejection from the one of the ejection openings immediately after the preliminary vibration, the preliminary vibration being performed immediately before the end of the downtime to vibrate a meniscus formed nearby the one of the ejection openings to the extent that the liquid is not ejected from the one of the ejection openings, wherein the first preliminary vibration characteristic includes at least partially a varying range in which the smallest number of vibrations in the preliminary vibration increases with an increase in the downtime, and is defined by a variable range of the downtime which does not exceed a maximum allowable downtime which is a longest downtime such that normal ejection from the one of the ejection openings is possible immediately after the preliminary vibration;

a preliminary operation data creating unit which is configured to create, based on the image data, preliminary operation data regarding preliminary ejection of ejecting liquid nearby the ejection openings to the recording medium by driving the plurality of actuators not based on the image data, before an image is recorded on the recording medium by the image recording control unit; and a preliminary operation control unit which is configured to control the plurality of actuators so that, when the image is recorded on the recording medium by the image recording control unit, the preliminary ejection is performed based on the preliminary operation data, and the preliminary vibration is performed for a number of times not smaller than the smallest number of vibrations corresponding to the downtime of the first preliminary vibration characteristic immediately before the end of the downtime of each of the ejection openings, the preliminary operation data creating unit calculating, for each of the ejection openings, a time interval between the preliminary ejection based on control by the preliminary operation control unit or liquid ejection based on control by the image recording control unit and a subsequent liquid ejection based on control by the image recording control unit, and generating the preliminary operation data such that, for at least one of the ejection openings where the downtime exceeds the maximum value of the variable range, the preliminary ejection is performed at the at least one of the ejection openings in the time interval to keep the downtime at the time of recording the image on the recording medium by the image recording control unit equal to or smaller than the maximum value of the variable range, and the downtimes of the respective openings are different from one another within the variable range.

2. The liquid ejection apparatus according to claim 1, wherein the preliminary operation data creating unit creates the preliminary operation data so that the downtime of each of the ejection openings is irregularly distributed within the variable range, based on a random number.

3. The liquid ejection apparatus according to claim 1, wherein the preliminary operation control unit controls the actuators so that the number of vibrations in the preliminary vibration is the smallest number of vibrations corresponding to the downtime based on the first preliminary vibration characteristic.

4. The liquid ejection apparatus according to claim 1, wherein the variable range includes at least partially a range of downtime in which the smallest number of vibrations in the preliminary vibration is zero.

5. The liquid ejection apparatus according to claim 1, wherein an upper limit value of the variable range is the maximum allowable downtime.

6. The liquid ejection apparatus according to claim 1, wherein, for each of the ejection openings, the preliminary operation data creating unit creates the preliminary operation data so that no preliminary ejection is performed from the ejection opening, when a time interval between the preliminary ejection based on control by the preliminary operation control unit or liquid ejection based on control by the image recording control unit and a subsequent liquid ejection based on control by the image recording control unit falls within a time interval which is not larger than a predetermined value which does not exceed the maximum value of the variable range.

7. The liquid ejection apparatus according to claim 6, wherein an upper limit value of the variable range is the predetermined value.

8. The liquid ejection apparatus according to claim 6, wherein:

the preliminary vibration number storage unit further stores a second preliminary vibration characteristic such that the smallest number of vibrations in the preliminary vibration is defined for the downtime from zero to a point which is earlier than the maximum allowable downtime;

for each of the ejection openings, the preliminary operation control unit controls corresponding one of the actuators to perform the preliminary vibration including at least the smallest number of vibrations corresponding to the downtime of the second preliminary vibration characteristic, immediately before an end of a period which is a time interval between the preliminary ejection based on control by the preliminary operation control unit or liquid ejection based on control by the image recording control unit and a subsequent liquid ejection based on control by the image recording control unit, the time interval being not more than the maximum downtime related to the second preliminary vibration characteristic.

9. The liquid ejection apparatus according to claim 8, wherein the predetermined value is the maximum downtime related to the second preliminary vibration characteristic.

10. The liquid ejection apparatus according to claim 1, wherein the preliminary vibration starts immediately before the end of the downtime.

11. The liquid ejection apparatus according to claim 1, wherein the downtime occurs during the recording of the image on the recording medium.

* * * * *